United States Patent [19]

Gutschmit

[11] Patent Number: 4,877,170

[45] Date of Patent: Oct. 31, 1989

[54] TUBULAR CONDUIT FOR TRANSPORTING TRAVELING TEXTILE YARN

[76] Inventor: Alan Gutschmit, P.O. Box 708, Troy, N.C. 27371

[21] Appl. No.: 693,532

[22] Filed: Jan. 22, 1985

[51] Int. Cl.[4] ..... B65H 57/12

[52] U.S. Cl. ..... 226/196

[58] Field of Search ..... 226/196; 57/315, 344, 57/352; 66/125 R, 126; 28/246; 138/37, 40, 42, 121, 173

[56] References Cited

U.S. PATENT DOCUMENTS

| | | | |
|---|---|---|---|
| 2,340,577 | 2/1944 | Bradshaw | 34/23 |
| 2,456,384 | 12/1948 | Conaway | 28/246 |
| 2,580,991 | 1/1952 | Barrett | 66/126 |
| 2,977,780 | 4/1961 | Smith | 66/126 |
| 3,248,515 | 4/1966 | Gorman et al. | 226/196 X |
| 3,875,731 | 4/1975 | Khomyakov et al. | 57/58.95 |
| 3,958,404 | 5/1976 | Kanai | 57/352 |
| 4,022,007 | 5/1977 | Motobayashi et al. | 57/58.95 |
| 4,112,660 | 9/1978 | Ferrentino et al. | 57/59 |
| 4,141,206 | 2/1979 | Eaves | 57/290 |
| 4,395,872 | 8/1983 | Riedl | 57/291 |

*Primary Examiner*—John M. Jillions

*Attorney, Agent, or Firm*—Shefte, Pinckney & Sawyer

[57] ABSTRACT

A tubular conduit for transporting a traveling texile yarn is formed of ordinary circular nylon tubing provided with a plurality of crimps formed at longitudinal spacings to provide interior projecting edge portions in the tubular conduit. The traveling yarn contacts the interior wall surface of the tubular conduit essentially only at the projecting edge portions to reduce frictional contact between the yarn and the tubular conduit to prevent yarn tension increases and yarn breakage.

13 Claims, 1 Drawing Sheet

FIG. 1
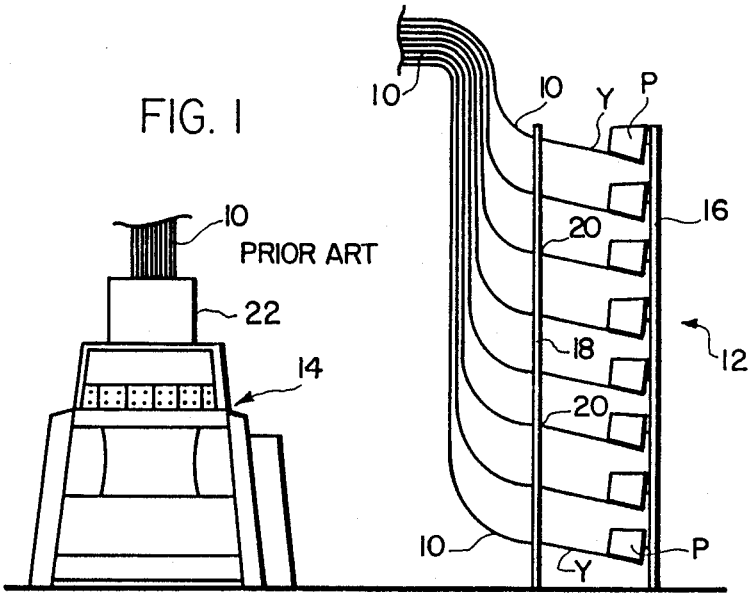
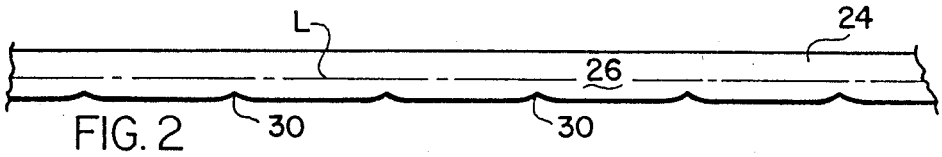
FIG. 2
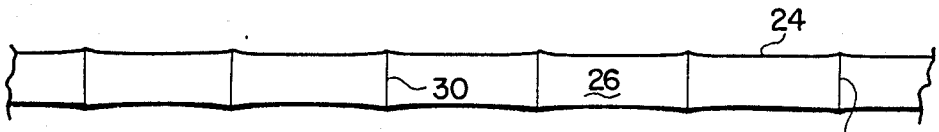
FIG. 3

TUBULAR CONDUIT FOR TRANSPORTING TRAVELING TEXTILE YARN

BACKGROUND OF THE INVENTION

The present invention relates to tubular conduits of the type adapted and used for transporting a traveling textile yarn or the like from one location to another.

Over recent years, it has become an increasingly widespread practice in the textile industry throughout the world to utilize tubular conduits to transport textile yarns from one location to another in order to shield the yarn to prevent the accumulation of lint thereon as well as to prevent the release of fibrous lint therefrom into the ambient atmosphere. Furthermore, in operations requiring the simultaneous transportation of a plurality of yarns, the use of a separate tubular conduit for each yarn readily facilitates the compact and organized handling of the traveling yarns without entanglement therebetween. For instance, one situation in which tubular conduits of this type have been widely used is the feeding of plural yarns from a creel supporting a plurality of yarn packages to a textile machine utilizing the yarns, e.g., a circular knitting machine. Co-pending U.S. patent application Ser. No. 598,266, filed Apr. 9, 1984, now U.S. Pat. No. 4,540,138 for a Textile Yarn Creel discloses such a use of yarn transporting tubular conduits. Typically, the tubular conduits utilized are ordinary small-diameter flexible nylon or other plastic tubing which is readily available and advantageously facilitates bending or curving of the conduit into various curvi-linear conditions to define a desired yarn traveling pathway.

In most yarn transporting operations, such tubular conduits operate very satisfactorily. However, problems of unacceptably high yarn tension and even yarn breakage have been encountered throughout the textile industry in attempting to utilize such tubular conduits for transporting polyester and some other synthetic yarns, particularly such filament yarns. In certain instances, the problem has been considered so acute that the use of tubular yarn transporting conduits has been abandoned altogether. One obstacle to the solution of this problem is that there does not seem to be any consensus within the textile industry as to the cause of this problem. Some persons theorize that the necessarily resulting frictional interaction between the polyester or other synthetic yarn and the nylon or other synthetic tubing creates a progressively increasing static electrical charge within the tubing which creates the undesirably high yarn tension and may ultimately cause yarn breakage. On the other hand, other persons believe that the polyester or other synthetic yarn tends to progressively wear and abrade the otherwise smooth interior surface of the tubing to the extent that ultimately friction between the yarn and tubing causes the yard tension and breakage problems. While either or both of these theories may be correct at least in part, the applicant has also discovered that variations in the amount of lubricating "coning" oil ordinarily placed on polyester and other synthetic yarns in finishing affects friction between the yarn and the tubing and particularly that an excess of the oil can unexpectedly produce an increase, rather than decrease, in yarn tension and breakage, indicating that excess oil increases friction between the yarn and the tubing.

Irrespective of the precise actual explanation for the cause of this problem, it appears that frictional interaction between the yarn and the tubing is at the root of the problem. In order to reduce friction, some textile equipment manufacturers have begun providing tubular conduit systems particularly designed for polyester and other synthetic yarns, utilizing only linear tubular sections angularly joined with one another by short connecting elbows. Presumably, frictional contact of any substantial extent between the yarn and this tubing system occurs primarily at the elbows, but not in the linear sections, whereby the overall amount of frictional contact between the yarn and the tubing system is reduced. While such tubing systems seem to experience fewer yarn tension and breakage problems in handling polyester and other synthetic yarns, such tubing systems must be specially constructed and dimensioned for each individual application and are more costly due in part to the necessary use of the elbow-type connectors and due as well to the increased assembly time and labor required to interconnect and set-up the linear tubular sections and the connecting elbows. Ordinary flexible tubing is considered much more desirable to use in that it can be readily bent and flexed to assume curvi-linear configurations to accommodate any particular yarn transporting requirement.

In contrast, the present invention provides an improved tubular conduit of a flexible character adapted for assuming curvi-linear conditions in generally conventional manner and specially provided with a novel interior wall configuration effective to substantially reduce frictional contact between the traveling yarn and the tubular conduit.

SUMMARY OF THE INVENTION

The tubular conduit of the present invention is broadly adapted for transporting a traveling textile yarn or the like from one location to another. Briefly described, the tubular conduit includes an annular interior wall surface defining a yarn pathway and has a plurality of interior yarn engaging portions projecting inwardly from the annular interior wall surface at spacings along the length of the tubular conduit. The yarn engaging portions are adapted to support the yarn and maintain it out of substantial contact with the interior wall surface intermediate the yarn engaging portions to reduce the amount of frictional contact between the yarn and the tubular conduit as the yarn travels in the pathway therethrough.

In the preferred embodiment, the tubular conduit is formed of nylon tubing material having a continuous annular wall and is adapted to assume a curvi-linear operative yarn transporting condition. The yarn transported with the tubular conduit preferably is formed of polyester fiber. The yarn engaging portions are formed as inward deformations in the tubular conduit, preferably as crimps therein, and the tubular conduit is of substantially circular cross-section intermediate the crimps, so that each yarn engaging portion provides generally point contact with the traveling yarn.

In one embodiment, the yarn engaging portions are formed annularly about the annular interior wall surface. In another embodiment, the yarn engaging portions are formed at one annular side of the annular interior wall surface.

BRIEF DESCRIPTION OF THE DRAWINGS

FIG. 1 is a side elevation illustrating a conventional prior art arrrangement of plural tubular conduits transporting respective yarns from a textile yarn package creel to a textile circular knitting machine;

FIG. 2 is a side elevation of a tubular conduit according to the present invention, shown in linear condition;

FIG. 3 is a front elevation thereof;

DESCRIPTION OF THE PREFERRED EMBODIMENT

Figure 4:
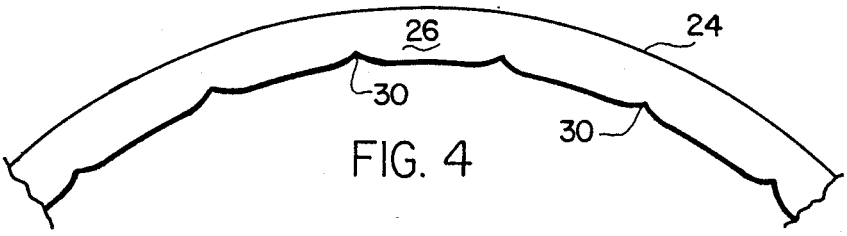
FIG. 4 is another side elevation of the tubular conduit of FIG. 2, showing it in a flexed curvi-linear condition.

Referring now to the accompany drawings, and initially to FIG. 1, there is shown a conventional prior art arrangement of a plurality of tubular conduits 10 extending between a textile yarn creel 12 and a circular knitting machine 14 for feeding a corresponding plurality of individual yarns Y from yarn packages P supported in an array on an upright yarn package supporting member 16 of the creel 12. The creel 12 includes an upright yarn guide eyelet supporting member 18 positioned adjacent the yarn package supporting member 16 and carrying a plurality of yarn guide eyelets 20 in an array adjacent and corresponding to the packages P on the yarn package supporting member 16. An individual tubular conduit 10 is operatively connected to each yarn guide eyelet 20 to receive yarn trained therethrough. The plural tubular conduits 10 are directed in a curvi-linear path upwardly from the eyelet supporting member 18, are accumulated in a bundle and are collectively directed therefrom overhead to a receiving superstructure 22 mounted on the top of the frame of the knitting machine 14. Thus, each yarn Y is drawn from its package P, is trained through a respective yarn guide eyelet 20, and travels through the respective tubular conduit 10 to the superstructure 22 of the knitting machine 14, from which the yarn Y is trained through a conventional arrangement of guide eyelets (not shown) to a respective yarn feeding station of the knitting machine 14 at which the yarn Y is fed to the needles of the machine. Conventionally, ordinary extruded plastic tubing, typically of a nylon material, having a circular uniform cross-sectional configuration and dimension, is utilized for the tubular conduits 10.

With reference now to FIGS. 2–7, there is shown a first embodiment of an improved tubular conduit 24 according to the present invention for use in replacement of the conventional tubular conduits 10. The tubular conduit 24 is formed of the same circular nylon tubing as the conventional tubular conduits 10 having a continuous annular wall 26 defining an interior yarn pathway 28 through the tubular conduit 24, but in contrast to the tubular conduit 10, the conduit 24 is deformed inwardly at regular longitudinal spacings along the length of the conduit 24 by crimps 30 which produce yarn engaging edge portions 32 projecting inwardly from the interior wall surface 26' of the annular wall 26. Each crimp 30 is formed as a linear depression in the annular wall 26 of the tubular conduit 24 with the linear extent of the crimp 30 oriented substantially perpendicularly to the longitudinal centerline L of the tubular conduit 24 and being formed in only one annular side of the annular wall 26 (see FIGS. 3 and 7). As with conventional nylon tubing, the tubular conduit 24 is sufficiently flexible to be bent, twisted or otherwise manipulated to various desired curvi-linear conditions and configurations to provide a suitable yarn conveying pathway from one location to another. As will be understood, each crimp 30 provides a bending axis along its linear extent to readily facilitate bending of the tubular conduit 24 thereabout toward the annular side of the annular wall 26 in which the crimp 30 is formed (see FIG. 4). Preferably, in any curvi-linearly bent section of the tubular conduit 24, all of the crimps 30 therealong are formed at the radially-inwardly facing annular side of the tubular conduit 24, thereby facilitating the bending and furthermore locating the interior projecting edge portions 32 at the annular side of the annular interior wall surface 26' along which the yarn Y is most likely to travel in such curvi-linear section of the tubular conduit 24 (see FIG. 6). In this manner, the interior projecting edge portion 32 formed by each crimp 30 in the annular interior wall surface 26' provides an essentially linear edge surface oriented substantially perpendicularly to the direction of travel of the yarn Y in the interior pathway 28 through the tubular conduit 24.

Figure 5:
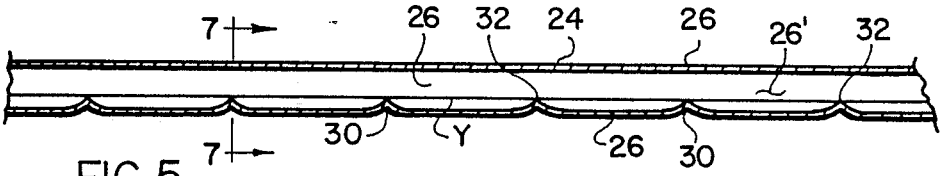
FIG. 5 is a longitudinal section of the tubular conduit in its linear condition of FIG. 2.
Figure 6:
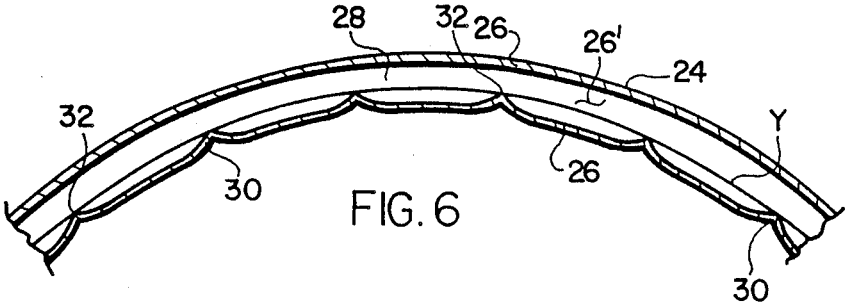
FIG. 6 is another longitudinal section of the tubular conduit in its curvi-linear condition of FIG. 4.
Figure 7:
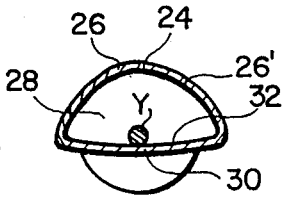
FIG. 7 is a diametrical section of the tubular conduit taken along line 7—7 of FIG. 5.

As best seen in FIGS. 5–7, in yarn transporting operation of the tubular conduit 24, the interior projecting edge portions 32 provide substantially point-contact with the yarn Y when it comes in contact therewith while traveling through the pathway 28. As will be understood, the yarn Y is particularly likely to come in contact with the radially inward annular side of the annular interior wall surface 26' as the yarn Y travels through curvi-linear sections of the tubular conduit 24. Thus, in such curvi-linear sections, the interior projecting edge portions 32 substantially restrict the frictional surface contact between the yarn Y and the annular interior wall surface 26' to only a relatively few contact points at the interior projecting edge portions 32 of the crimps 30 in such curvi-linear sections (FIG. 6). As a result, the yarn Y is maintained out of substantial contact with the annular interior wall surface 26' throughout the length of the tubular conduit 24 and particularly along its curvi-linear sections so that frictional drag on the traveling movement of the yarn Y is minimized. Accordingly, the tubular conduit 24 places little additional tension on the yarn Y over and above the natural tension placed therein in creating its traveling movement and the risk and incidence of yarn breakage is essentially eliminated. Furthermore, the tubular conduit 24 provides the same advantages of convenience and inexpensiveness as conventional nylon tubing in that the tubular conduit 24 is a unitary flexible length of tubing bendable to various curvi-linear configurations and does not require assembly using connecting elbows or other couplings.

Figure 8:
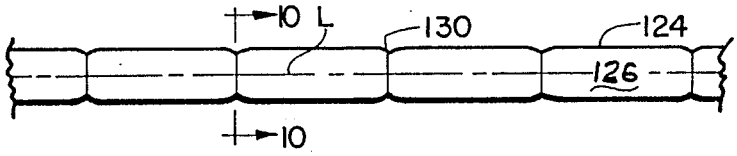
FIG. 8 is a side elevation of another embodiment of tubular conduit according to the present invention.
Figure 9:
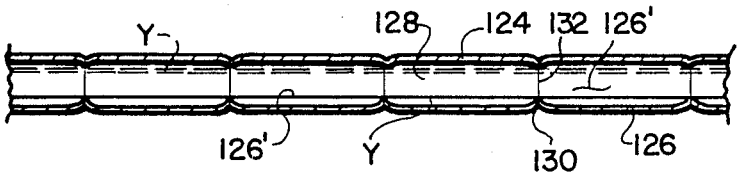
FIG. 9 is a longitudinal section thereof.
Figure 10:
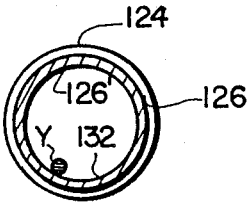
FIG. 10 is a diametrical section thereof taken along line 10—10 of FIG. 8.

Referring now to FIGS. 8–10, a tubular conduit 124 is shown according to a second embodiment of the present invention. The tubular conduit 124 is also formed of conventional circular nylon tubing, but has longitudinally spaced crimps 130 along the length of the tubular conduit 124 inwardly deforming the annular wall 126 thereof about the full annular circumference of the annular wall 126 to form circular edge portions 132 projecting inwardly from the interior wall surface 126' of the annular wall 126 completely annularly thereabout. Each crimp 130 is formed as a substantially circular depression in the annular wall 126 substantially perpendicularly to the longitudinal centerline L of the pathway 128 defined by the tubular conduit 124 so that the annular edge portions 32 provide a substantially circular surface line substantially perpendicularly to the direction of yarn travel through the pathway 28 for essentially point contact with the yarn Y as it travels through the tubular conduit 24. Advantageously, the full annular nature of the crimps 130 in the tubular conduit 124 permit it to be bent or flexed in any radial direction relative to the longitudinal centerline of the tubular conduit 124 to form into various curvi-linear configurations, with the annular portions of the crimps 130 at the radially inward side of any curvi-linear or similarly bent or flexed section of the tubular conduit 124 acting as bending axes in substantially the same manner as the linear crimps 30 in the tubular conduit 24 of FIGS. 2–7, as described above. As will readily be understood, the tubular conduit 124 provides as well all of the same advantages as the tubular conduit 24 in reducing the amount of yarn frictional contact between the yarn Y and the annular interior wall surface 126' to minimize frictinal drag of and tension increase in the yarn Y as it travels through the tubular conduit 124 and to substantially eliminate yarn breakages.

Each embodiment of the tubular conduits 24,124 has been found to very satisfactorily perform in experimental use for transporting polyester and similar synthetic filament yarns without experiencing significant yarn tension increases or yarn breakage problems which experience as shown characteristically occur in transporting such yarns through conventional uncrimped nylon tubing. Inasmuch as the particular cause of yarn tension and breakage problems occurring with conventional tubing is a matter of some dispute within the textile industry as discussed above, the reason or reasons for the advantageous results and elimination of these problems in using the present improved tubular conduits 24,124 is not known. However, since there is general consensus in the textile industry that frictional interaction between the traveling yarn and the tubular conduit at least contributes to the problems experienced with conventional tubing, it is believed that the operative effect of the present tubular conduits 24,124 in limiting frictional contact between the yarn Y and the annular interior wall surfaces 26',126' to essentially only contact points on the interior projecting edge portions 32,132 formed by the crimps 30,130 is the primary reason for the significantly improved results achieved in the use of the present tubular conduits 24,124.

The crimps 30,130 may be formed by various operations in the nylon tubing from which the tubular conduits 24,124 are made. Nylon tubing of the conventional type preferably used has been found to have a significant memory when deformed by crimping in the manner of the present invention and therefore will retain deformations such as the crimps 30,130 once placed therein. Various forms of metal and plastic deforming presses and the like are widely known in the metal and plastic forming arts, many of which may be readily adapted or modified for forming the crimps 30,130 at regular longitudinal spacings in conventional nylon tubing on a commercial scale. It is contemplated that a rotary crimping press through which conventional nylon tubing is fed may provide the most efficient commercial system for forming the crimps 30,130 therein. Alternatively, it may be possible to modify the process of extruding nylon and other synthetic plastic tubing to form the crimps 30,130 therein during the extrusion process. Other various apparatus and methods of producing the crimped tubular conduits 24,124 will be apparent to those persons skilled in the art.

It will also be understood by those persons skilled in the art that tubular conduits according to the present invention may be fabricated of other materials than nylon tubing and may be equally well employed for transporting substantially any yarn or other strand-like material where the minimization of friction and tension thereon and the avoidance of possible material breakage is of concern. Furthermore, it will be appreciated that interior projecting edge portions in tubular yarn transporting conduits as conceived by the present invention may be formed by methods other than crimping of the tubing employed. Similarly, interior projecting edge portions other than the linear edge portions 124 may be provided. For example, it is contemplated that a continuous spiral interior edge portion extending along the length of the tubing will operate equally effectively in the manner contemplated by the present invention. All such modifications and variations of the present inventions are considered to be within the scope of the present invention. The present invention has been described in detail above with regard to its preferred embodiments for purposes of illustration only and is not intended to be limited by this description or otherwise to exclude any variation or equivalent arrangement that would be apparent from, or reasonably suggested by, the foregoing disclosure to persons skilled in the art.

I claim:

1. A continuous extended length flexible tubular conduit adapted to be resiliently formed to selected curvi-linear configurations for transporting a traveling textile yarn or the like in curvi-linear paths from one location to another remote location, said tubular conduit comprising an annular interior wall surface defining a yarn pathway and a plurality of interior yarn engaging portions projecting inwardly from said annular interior wall surface at spacings along the length of said tubular conduit, said yarn engaging portions being adapted to engagingly support said yarn and maintain it out of substantial contact with said interior wall surface intermediate said yarn engaging portions to reduce the amount of frictional contact between said yarn and said tubular conduit as said yarn travels in said pathway therethrough, said yarn engaging portions comprising inwardly formed deformations in said tubular conduit forming crimps therein.

2. A tubular conduit according to claim 1 and characterized further in that each said yarn engaging portion is formed annularly about said annular interior wall surface.

3. A tubular conduit according to claim 1 and characterized further in that each said yarn engaging portion is formed at one annular side of said annular interior wall surface.

4. A tubular conduit according to claim 1 and characterized further in that each said yarn engaging portion provides generally point contact with said yarn.

5. A tubular conduit according to claim 1 and characterized further in that said tubular conduit is adapted to assume a curvi-linear operative yarn transporting condition.

6. A tubular conduit according to claim 1 and characterized further in that said tubular conduit is formed of nylon and said yarn is formed of polyester fiber.

7. A continuous length tubular conduit for transporting a traveling textile yarn or the like from one location to another remote location, said tubular conduit being flexibly adapted to assume curvi-linear operative yarn transporting conditions, said tubular conduit comprising a continuous annular wall defining an interior yarn pathway therethrough, said annular wall having a plurality of crimps formed therein at spacings along the length of said tubular conduit, said crimps deformng said annular wall to produce a corresponding plurality of longitudinally spaced yarn engaging edge portions projecting inwardly from the interior wall surface of said annular wall, said edge portions being adapted for generally point contact with said yarn to support it and maintain it out of substantial contact with the annular interior wall surface of said annular wall intermediate said edge portions to reduce the amount of frictional contact between said yarn and said tubular conduit as said yarn travels in said pathway therethrough.

8. A tubular conduit according to claim 7 and characterized further in that each said yarn engaging portion is formed annularly about said annular interior wall surface.

9. A tubular conduit according to claim 7 and characterized further in that each said yarn engaging portion is formed at one annular side of said annular interior wall surface.

10. A tubular conduit according to claim 7 and characterized further in that said tubular conduit is formed of nylon and said yarn is formed of polyester fiber.

11. A continuous length tubular conduit for transporting a traveling textile yarn formed of polyester fiber from one location to another remote location, said tubular conduit being formed of nylon material flexibly adapted to assume curvi-linear operative yarn transporting conditions, said tubular conduit comprising a continuous annular wall defining an interior yarn pathway therethrough, said annular wall having a plurality of crimps formed therein at periodic spacings along the length of said tubular conduit and said annular wall being substantially circular in cross section intermediate said crimps, said crimps deforming said annular wall to produce a corresponding plurality of longitudinally spaced yarn engaging edge portions projecting inwardly from the interior wall surface of said annular wall, said edge portions being adapted for generally point contact with said yarn to support it and maintain it out of substantial contact with the annular interior wall surface of said annular wall intermediate said edge portions to reduce the amount of frictional contact between said yarn and said tubular conduit as said yarn travels in said pathway therethrough.

12. A tubular conduit according to claim 11 and characterized further in that each said yarn engaging portion is formed annularly about said annular interior wall surface.

13. A tubular conduit according to claim 11 and characterized further in that each said yarn engaging portion is formed at one annular side of said annular interior wall surface.

* * * * *

UNITED STATES PATENT AND TRADEMARK OFFICE

CERTIFICATE OF CORRECTION

PATENT NO. : 4,877,170

DATED : October 31, 1989

INVENTOR(S) : Alan Gutschmit

It is certified that error appears in the above-identified patent and that said Letters Patent is hereby corrected as shown below:

Column 1, Line 56, reads "yard" but should read -- yarn --.

Column 3, Line 22, reads "accompany" but should read -- accompanying --.

Column 5, Line 5, reads "edge portions 32" but should read -- edge portions 132 --.

Column 5, Line 7, reads "pathway 28" but should read -- pathway 128 --.

Column 5, Line 9, reads "tubular conduit 24" but should read -- tubular conduit 124 --.

Column 5, Line 24, reads "frictinal" but should read -- frictional --.

Column 5, Line 32, reads "as" but should read -- has --.

Column 6, Lines 23-24, reads "inventions" but should read -- invention --.

Column 7, Line 9, reads "deformng" but should read -- deforming --.

Signed and Sealed this

Eighth Day of September, 1992

*Attest:*

DOUGLAS B. COMER

*Attesting Officer*

*Acting Commissioner of Patents and Trademarks*